United States Patent [19]

Petralia

[11] 4,315,302

[45] Feb. 9, 1982

[54] QUARTZ LIGHT FIXTURE

[75] Inventor: Salvatore C. Petralia, Sayreville, N.J.

[73] Assignee: Keene Corporation, New York, N.Y.

[21] Appl. No.: 885,634

[22] Filed: Mar. 13, 1978

[51] Int. Cl.[3] ..... H01R 33/00

[52] U.S. Cl. ..... 362/226; 362/223; 362/365

[58] Field of Search ..... 362/217, 223, 225, 226, 362/365, 368, 366, 396

[56] References Cited

U.S. PATENT DOCUMENTS

| | | | |
|---|---|---|---|
| 2,559,640 | 7/1951 | Kruger | 362/396 X |
| 3,087,981 | 4/1963 | Harling | 362/396 X |
| 3,328,578 | 6/1967 | Gough | 362/217 |
| 3,590,241 | 6/1971 | Docimo et al. | 362/366 X |
| 3,700,887 | 10/1972 | Marx | 362/396 |
| 4,148,095 | 4/1979 | Haynen | 362/396 X |

*Primary Examiner*—Peter A. Nelson

*Attorney, Agent, or Firm*—Kane, Dalsimer, Kane, Sullivan and Kurucz

[57] ABSTRACT

A light fixture is provided comprising a base containing a lamp socket and the associated wiring. The base contains a cast latch striker which cooperates with a complementary latch mechanism on a reflector assembly to secure the reflector assembly to the base. The reflector assembly includes a reflector and lens designed to overlie an open end of the base and seal the same when the latch member is engaged.

6 Claims, 3 Drawing Figures

QUARTZ LIGHT FIXTURE

BACKGROUND OF THE INVENTION

The present invention relates to light fixtures and in particular to quartz light fixtures.

Presently available quartz light fixtures are designed for a wide range of lighting applications. Such fixtures comprise a base unit having a lamp socket and an appropriate reflector and lens which serve to direct the light from the lamp into a desired pattern. The pattern generally determines the specific purpose for which the fixture is to be used. For example, an outdoor light for use in a parking lot or athletic field might have a reflector and lens designed to cast a broad beam whereas a light used to reflect a display sign or to illuminate a particular area such as a doorway or starwell would have a reflector and lens designed to cast a narrow beam.

Heretofore, such quartz light fixtures have been manufactured and sold as integral units. That is, the base and reflector portions were specifically designed for each other and for a particular purpose. As a result, it was necessary for dealers and distributors to maintain extensive inventories of a wide range of fixtures corresponding to the range of possible applications. In addition, because of the interrelationship of the base and reflector of prior art fixtures, the changing of lamps was a rather difficult and complex problem requiring disassembly of at least a portion of the fixture.

SUMMARY OF THE INVENTION

In view of the above, it is the principal object of the present invention to provide an improved quartz light fixture which overcomes the problems of the prior fixtures.

The above and other beneficial objects and advantages are attained in accordance with the present invention by providing an improved quartz light fixture wherein the component parts are modulized. The parts common to a wide variety of fixtures are contained in a common base unit designed to be used with any one of several reflector assemblies. The parts specific for a particular fixture are contained in the reflector assembly. The base unit contains a cast latch striker which cooperates with a complementary latch mechanism on the reflector unit to secure the two together along with an appropriate sealing gasket. When the reflector assembly is removed from the base unit, the lamp sockets are readily accessible thus greatly simplifying the changing of lamps. By providing the same latch assembly on each of the wide variety of reflector units each one of which is compatible with the complementary part on the base unit, any one of the reflector units may be used with the common base to create a variety of quartz light fixtures.

The reflector assembly is completely self-contained. It includes both side and bottom portions of the reflector with appropriate cutouts in the bottom portion to permit a lamp secured to the base sockets to protrude within the reflector.

DETAILED DESCRIPTION OF THE PREFERRED EMBODIMENT

Figure 1:
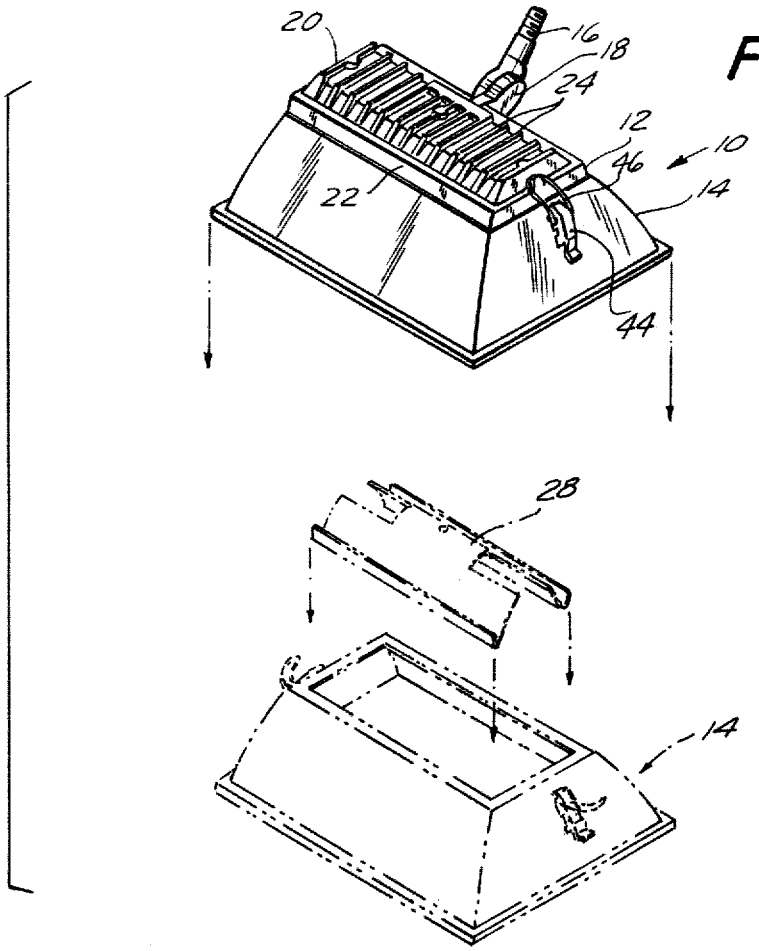
FIG. 1 is a perspective view of a quartz light fixture in accordance with the present invention. The reflector assembly is shown attached to the base unit in solid line and disassembled from the base unit in phantom.
Figure 2:
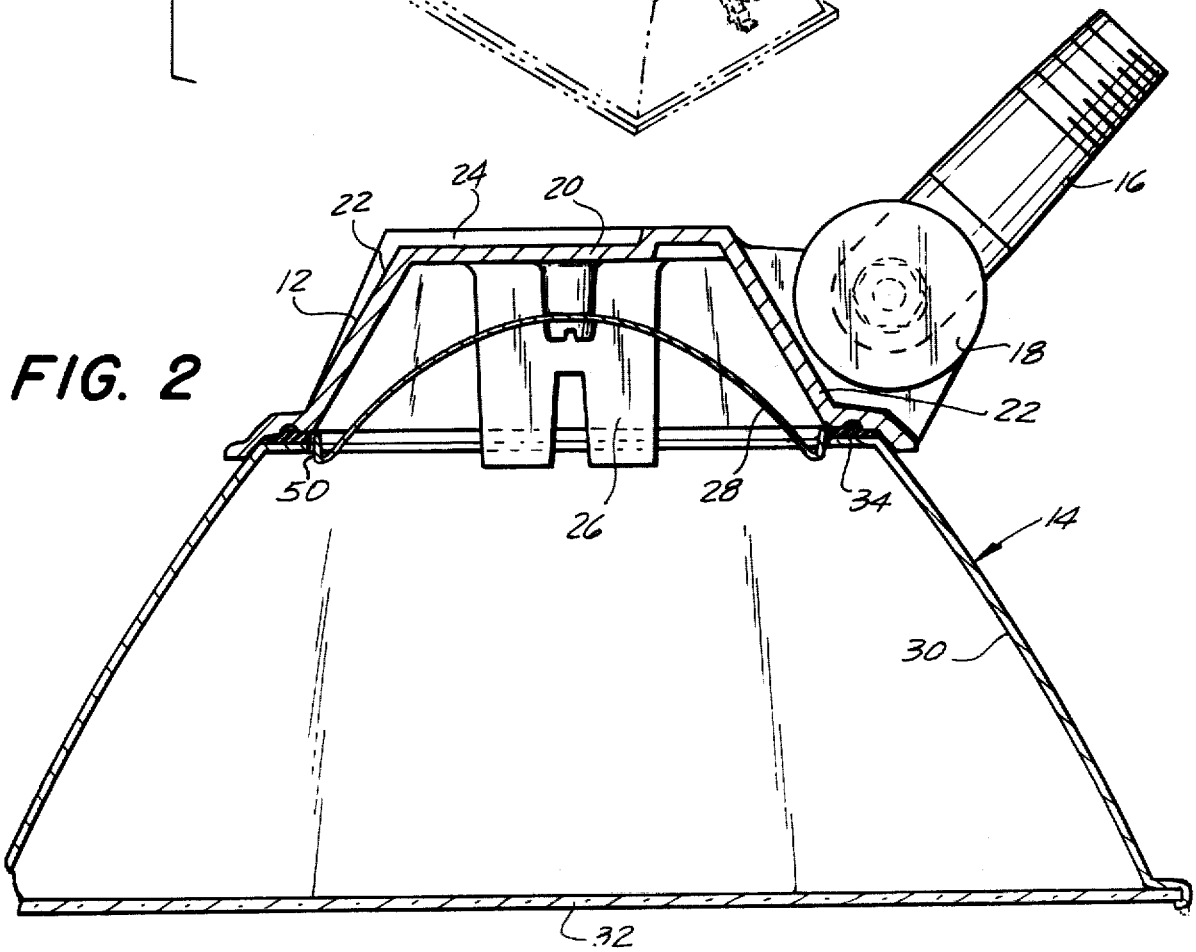
FIG. 2 is a side elevational view of the assembled quartz light fixture of FIG. 1; and, FIG. 3 is an elevational view, partly in section, of an assembled fixture.

Reference is now made to the drawings wherein similar components bear the same reference numerals throughout the several views. In FIG. 1, a high intensity light fixture 10 in accordance with the present invention is shown. The fixture comprises a base unit 12 and reflector assembly 14. An arm 16 is mounted through pivot joint 18 to the base unit and electrical wiring is brought into the fixture through arm 16. The arm may be connected to a suitable mounting plate for mounting the fixture to a wall, pole or stantion.

Base unit 12 is formed of an appropriate high heat conductive material such as cast aluminum. The base unit comprises a base portion 20 from which side walls 22 extend. A series of heat radiating fins 24 are formed on the outer surface of the base portion to help dissipate heat generated by the lamp within the fixture. A pair of lamp socket means 26 are cast in as part of the base portion. The sockets are connected to line wires (not shown) which enter the fixture through arm 16. As stated, side walls 22 extend from base portion 20 terminating in an upper surface.

The reflector assembly 14 comprises a self-contained reflector and lens sub-assembly designed to be coupled to the base unit. To this end, the reflector assembly includes an inner portion 28 which is mounted within the base and surrounds the socket assembly and an outer portion 30 which extends away from the base portion to define an open end of the fixture. The outer reflector 30 centers on a pilot 50 in the form of a flange surrounding the upper edge of the inner portion. As shown, the open end of the reflector assembly is closed by an appropriate lens 32. The inner surfaces of the reflector assembly portions are specular or diffuse to provide a suitable and good reflecting surface. In this connection, the reflector assembly may be formed of a sheet material such as sheet aluminum. The outer surface of outer portion 30 is contoured to define extensions of the base unit side walls as shown in FIG. 1. In this manner, when the fixture is assembled it has a finished outward appearance. A suitable gasket 34 formed of silicone or the like is provided to insure a tight weatherproof seal between the base unit and reflector assembly.

Figure 3:
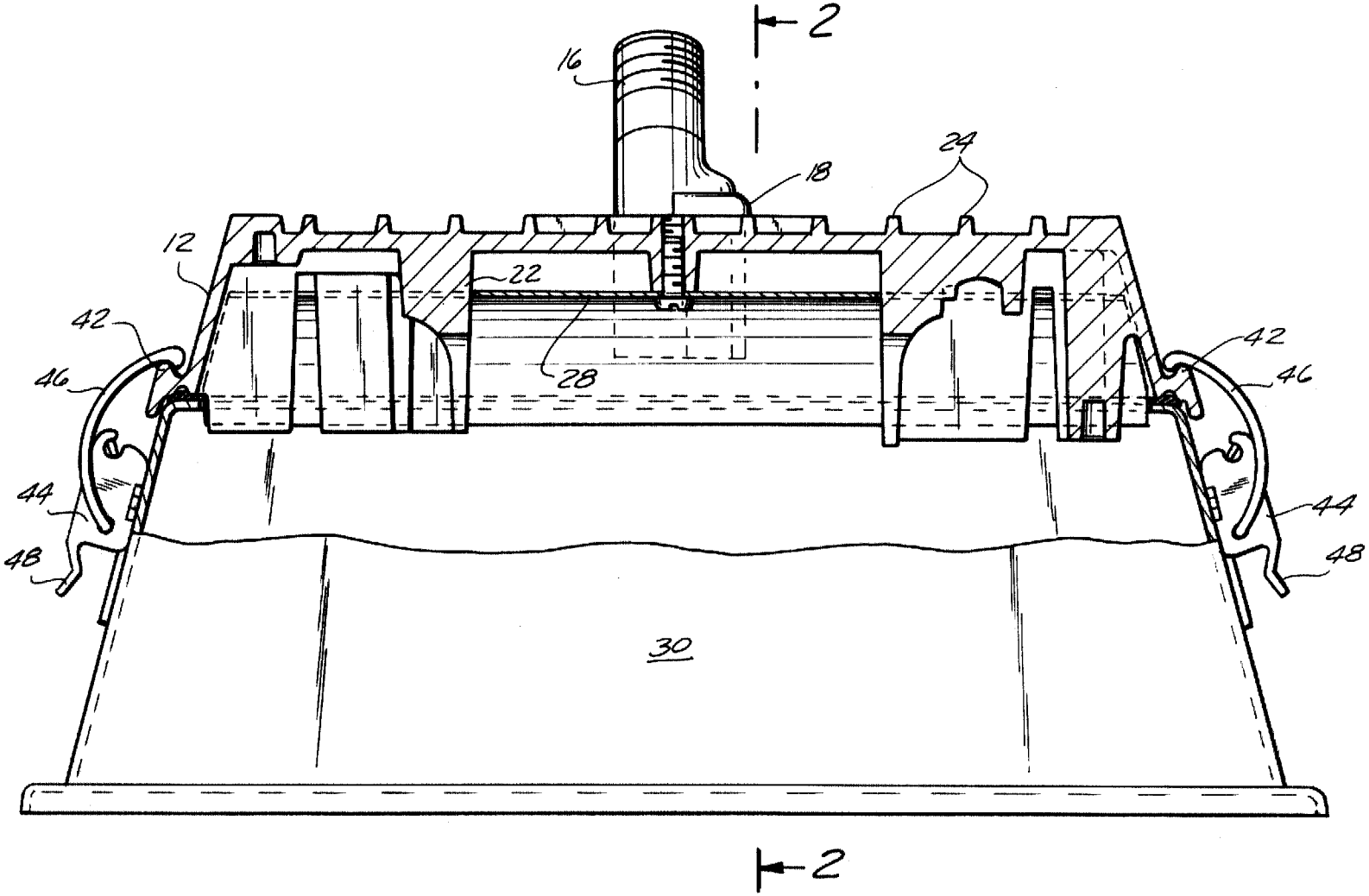

As shown in FIG. 1, the bottom surface 36 of the reflector assembly inner portion 28 is provided with a suitable cutout 38 to permit this portion of the reflector assembly to pass over socket 26. As shown best in FIG. 3, the base unit and reflector assembly outer portion is provided with complementary portions of a latch assembly 40 which permit the units to be readily assembled and disassembled with a minimum of effort. In this connection, a pair of strikers 42 are cast integral on a pair of opposite side walls of the base unit. A toggle latch mechanism 44 is secured to corresponding outer surfaces of the reflector assembly outer portion. The latch 44 includes a loop portion 46 designed to engage the striker and securely pull and lock the base unit and reflector assembly outer portion toward one another when pressure is applied to a thumb piece 48. The reflector assembly inner portion is captured in position. Thus, the unit may readily be assembled or disassembled by lowering or raising thumb piece 48 without the installer utilizing any tools whatsoever. It should be appreciated that when the latch mechanism 40 is disengaged, the entire reflector assembly may be removed exposing the fixture lamp and sockets. This greatly simplifies the task of changing and maintaining lamps within the fixture.

The curvature of reflecting surfaces 28 and 30 together with lens 32 defines the pattern for light emanating from the fixture. Accordingly, to provide a fixture for any particular purpose, all that need be done is provide the appropriate reflector assembly with a common base. The distributor or installer can maintain an inventory of many different types of fixtures merely by maintaining an inventory of reflector assemblies. If a user has a fixture designed for one purpose and wishes to use it for a different purpose, the entire fixture need not be disregarded. All that need be done is that the latches are opened and the reflector assembly is removed. An appropriate reflector assembly is then snapped into position and the fixture is ready to be used.

Thus, in accordance with the above, the aforementioned objects are effectively attained.

I claim:

1. A quartz light fixture comprising: a base unit having side walls and a base portion; a top surface of said base portion from which said side walls extends, lamp receiving socket means secured to said top surface; a reflector assembly including a portion seating on a gasket provided between said reflector assembly portion and a top surface of said side walls, said reflector assembly portion surrounding said lamp socket and means for releasably coupling said reflector assembly portion to said base portion.

2. The fixture in accordance with claim 1 wherein said reflector assembly includes a first portion positioned within said base and secured thereto and a second portion extending outwardly from said base, said first portion including surfaces defining pilot means for centering said second portion.

3. The fixture in accordance with claim 1 wherein said coupling means comprises a tension clip mounted on said reflector assembly second portion and a complementary striker secured to said side walls.

4. The fixture in accordance with claim 2 further comprising a lens mounted in said reflector assembly second portion opposite said cutout lamp socket.

5. The fixture in accordance with claim 1 wherein said reflector assembly interior surfaces are formed of reflective material contoured to a desired predetermined curvature.

6. The fixture in accordance with claim 5 wherein said reflector assembly second portion contains exterior surfaces contoured to form extensions of the exterior of said base unit side walls.

* * * * *